US005943646A

United States Patent [19]

Wuppermann et al.

[11] Patent Number: 5,943,646

[45] Date of Patent: Aug. 24, 1999

[54] SIGNAL TRANSMISSION SYSTEM IN WHICH LEVEL NUMBERS REPRESENTING QUANTIZATION LEVELS OF ANALYSIS COEFFICIENTS ARE INTERPOLATED

[75] Inventors: Friedhelm Wuppermann; Fransiscus M. J. De Bont, both of Eindhoven, Netherlands

[73] Assignee: U.S. Philips Corporation, New York, N.Y.

[21] Appl. No.: 08/818,145

[22] Filed: Mar. 13, 1997

[30] Foreign Application Priority Data

Mar. 22, 1996 [EP] European Pat. Off. ..... 96200788

[51] Int. Cl.[6] ..... G10L 9/14

[52] U.S. Cl. ..... 704/230

[58] Field of Search ..... 704/230, 219, 704/221

[56] References Cited

U.S. PATENT DOCUMENTS 4,528,551 7/1985 Agrawal et al. .
4,815,134 3/1989 Picone et al. ..... 704/222
4,975,960 12/1990 Petajan ..... 704/251
5,012,518 4/1991 Liu et al. ..... 704/222
5,845,276 12/1998 Emerson et al. ..... 707/2

OTHER PUBLICATIONS

GSM Recommendation 06.10, European Telecommunication Standardisation Institute (ETSI) Jan. 1992.
"Speech Communication", Douglas O'Shaughnessy, CPT. 8, pp. 336–378, Addison–Wesley Publishing, 1990.

*Primary Examiner*—David R. Hudspeth
*Assistant Examiner*—M. David Sofocleous
*Attorney, Agent, or Firm*—Jack D. Slobod

[57] ABSTRACT

In a transmission system a signal is encoded in an encoder (7) and the encoded signal is transmitted by a transmitter (2) via a transmission medium (4) to a receiver (6). In the encoder, analysis parameters of the input signal are determined by an analyzer (8) and quantized by a quantizer (14). The transmitter transmits quantization level numbers to the receiver (6), and in the receiver decoded analysis parameters are derived by interpolating level numbers of two subsequent sets of analysis parameters, and subsequently determining the corresponding analysis. By interpolating the level numbers instead of the analysis parameters themselves, a substantial amount of computational complexity is saved.

9 Claims, 4 Drawing Sheets

SIGNAL TRANSMISSION SYSTEM IN WHICH LEVEL NUMBERS REPRESENTING QUANTIZATION LEVELS OF ANALYSIS COEFFICIENTS ARE INTERPOLATED

BACKGROUND OF THE INVENTION

1. Field of the Invention

The invention is related to a transmission system comprising a transmitter having an encoder for coding an input signal of the transmitter, said encoder comprising analysis means for deriving at least one analysis coefficient from the input signal, and quantization means for deriving a level number representing a quantization level of said analysis coefficient, the transmitter being arranged for transmitting an encoded signal comprising the level number to a receiver, the receiver comprising a decoder for deriving a decoded signal from the encoded signal. The present invention is also related to a transmitter, a receiver, an encoder, a decoder, a transmission method and an receiving method.

2. Description of the Related Art

A transmission system according to the preamble is known from GSM recommendation 06.10, GSM full rate speech transcoding published by European Telecommunication Standardisation Institute (ETSI) January 1992.

Such transmission systems can be used for transmission of e.g. speech signals via a transmission medium such as a radio channel, a coaxial cable or an optical fiber. Such transmission systems can also be used for recording of (speech) signals on a recording medium such as a magnetic tape or disc. Possible applications are automatic answering machines or dictating machines.

In modern speech transmission system, the speech signals to be transmitted are often coded using the analysis by synthesis technique. In this technique, a synthetic signal is generated by means of a synthesis filter which is excited by a plurality of excitation sequences. The synthetic speech signal is determined for a plurality of excitation sequences, and an error signal representing the error between the synthetic signal, and a target signal derived from the input signal is determined. The excitation sequence resulting in the smallest error is selected and transmitted in coded form to the receiver.

The properties of the synthesis filter are derived from characteristic features of the input signal by analysis means. In general, the analysis coefficients often in the form of so-called prediction coefficients are derived from the input signal. These prediction coefficients are regularly updated to cope with the changing properties of the input signal. The prediction coefficients are also transmitted to the receiver. In the receiver, the excitation sequence is recovered, and a synthetic signal is generated by applying the excitation sequence to a synthesis filter. This synthetic signal is a replica of the input signal of the transmitter.

Often the update period of the analysis coefficients is larger than the duration of an excitation sequence. Mostly, an integer number of excitation sequences fits in one update period of the analysis coefficients. In order to improve the quality of the signal synthesized at the receiver, in the known transmission system the interpolated analysis coefficients are calculated for each excitation sequence. With the interpolation between consecutive analysis coefficients a substantial amount of computations are involved.

A second reason for using interpolation is in the case one set of analysis parameters is received in error. An approximation of said erroneously received set of analysis parameters can be obtained by interpolating the level numbers of the previous set analysis parameters and the next set of analysis parameters.

OBJECT AND SUMMARY OF THE INVENTION

The object of the present invention is to provide a transmission system according to the preamble in which the computational complexity is reduced.

Therefore the transmission system according to the invention is characterized in that the decoder comprises interpolation means for deriving from at least two subsequently received level numbers corresponding to said analysis coefficient an interpolated level number, and in that the decoder comprises analysis coefficient decoding means for deriving a value for a decoded analysis coefficient corresponding to said interpolated level number.

By interpolating between level numbers, which are normally limited precision numbers, instead of interpolating between the prediction coefficients, which have a larger precision than the level numbers, substantial savings on the computational complexity required for interpolation can be obtained. Experiments have shown that interpolation between level numbers instead of interpolation of prediction coefficient values does not involve a decrease of encoding quality.

An embodiment of the invention is characterised in that the level numbers correspond to levels of a first type of analysis coefficient, and in that the decoded analysis coefficient is of a second type of analysis coefficient.

The present invention allows a direct generation of the second type of prediction coefficients from the interpolated level number by means of a table or by calculation means. In the transmission system known from the above mentioned standard, the level numbers have first to be converted to the first type of prediction parameter, and can only be converted into the second type of prediction parameter after interpolation.

A further embodiment of the invention is characterised in that the analysis means are arranged for deriving a plurality of analysis coefficients from the input signal, in that the decoder comprises means for deriving from the received level numbers for the analysis coefficients involved, analysis coefficient indices, and in that the analysis coefficient decoding means comprises common decoding table means for deriving decoded analysis coefficients corresponding to said analysis coefficient indices.

By deriving a suitable index from the received level number, it becomes possible to use one single table for determining the value of all prediction coefficients, instead of requiring a table for each prediction coefficient. The idea of replacing a plurality of tables comprising a table for each prediction coefficient by a single table for all prediction coefficients can also be applied in the encoder.

BRIEF DESCRIPTION OF THE DRAWINGS

The invention will now be explained with reference to the drawing, in which.

DETAILED DESCRIPTION OF THE PREFERRED EMBODIMENTS

Figure 1:
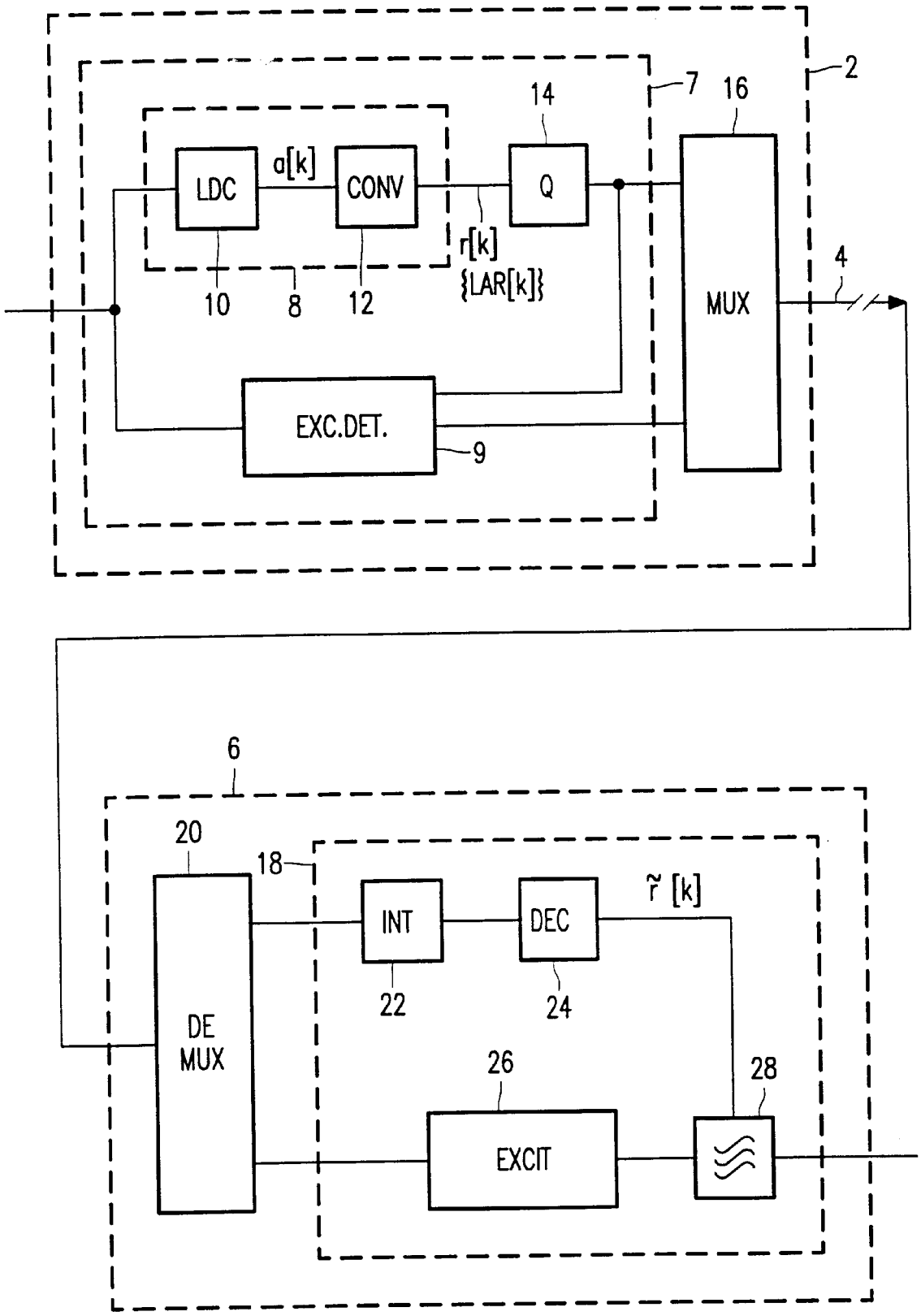
FIG. 1, a transmission system according to the invention.
Figure 2:
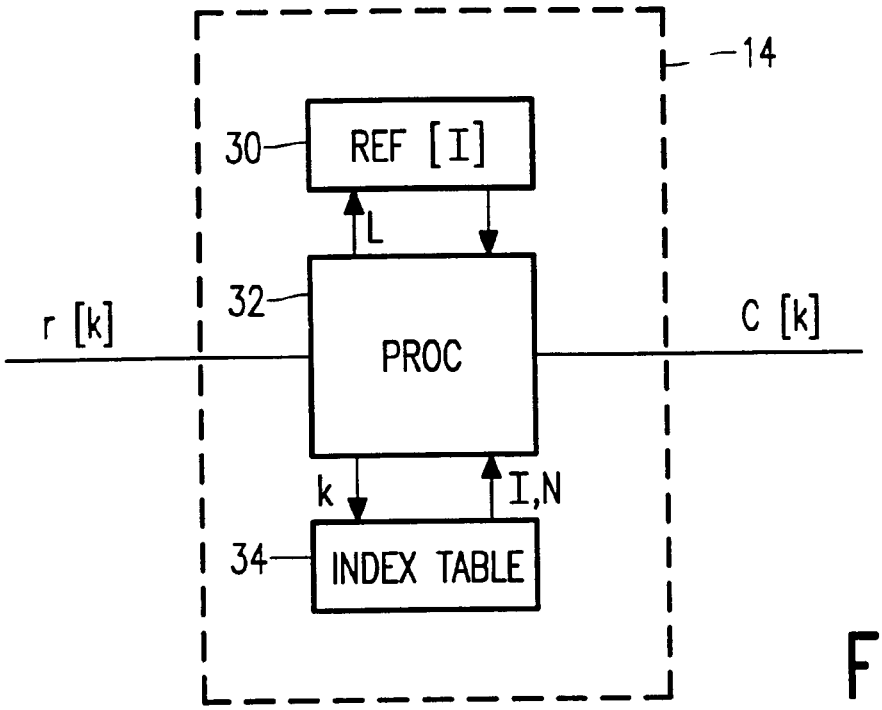
FIG. 2, an embodiment of the quantizer 14 for use in a transmission system according to FIG. 1.

In the transmission system according to FIG. 1, the input signal is applied to an input of a transmitter 2. In the transmitter 2, the input signal is applied to an input of an encoder 7. In the encoder 7, the input is connected to the analysis means or analyzer being here linear predictive analysis means 8, and to an input of excitation signal determination means 9. The linear predictive analysis means 8 comprise a cascade connection of a linear predictor 10, with output signal a[k] representing the analysis coefficients and a coefficient converter 12 with output signal r[k] or alternatively LAR[k].

The output of the linear predictive analysis means 8 is connected to an input of the quantization means or quantizer 14. An output of the quantization means 14 is connected to an input of a multiplexer 16 and to an input of the excitation signal determination means 9. The output of the excitation signal determination means 9 is connected to a second input of the multiplexer 16. The output signal of the multiplexer 16 is transmitted by the transmitter 2 via a transmission medium 4 to the receiver 6.

The input signal of the receiver 6 is connected to an input of a demultiplexer 20. A first and a second output of the demultiplexer 20 are connected to a corresponding input of a decoder 18. The first input of the decoder 18 is connected to an input of the interpolation means or interpolator 22. An output of the interpolation means 22 is connected to the analysis coefficient decoding means, being here prediction coefficient decoding means 24. The output of the prediction coefficient decoding means carrying an output signal $\tilde{r}$ is connected to an input of a synthesis filter 28.

The second input of the decoder 18 is connected to an input of an excitation signal generator 26. The output of the excitation signal generator 26 is connected to a second input of the synthesis filter 28. The output signal of the receiver is available at the output of the synthesis filter 28.

In the transmission system according to FIG. 1, it is assumed that the input signal is divided into frames each consisting of S subframes. The linear predictive analysis means 8 are arranged for determining for each frame P prediction coefficients. The linear predictor 10 determines prediction coefficients a[0] . . . a[P−1], in which the coefficients a[k] are chosen to minimize a prediction error E. The determination of the prediction coefficients a[k] and other types of prediction coefficients is well known to those skilled in the art, and is e.g. described in the book "Speech Communication" by Douglas O'Shaughnessy, Chapter 8, pp. 336–378.

The coefficient converter 12 transforms the prediction coefficients determined by the predictor 10 into a different type of prediction coefficient better suited for quantization and transmission. A first possibility is that the coefficient converter converts the coefficients a[k] into reflection coefficients r[k]. It is also possible that the reflection coefficients are converted into Log Area Ratios (LARs) according to:

$$LAR[k] = \log\left(\frac{1 + r[k]}{1 - r[k]}\right) \tag{1}$$

In the case LARs are used, these coefficients are uniformly quantized by the quantizer 14 with a quantization step 6. The decision levels are given by ±l·δ, l being a positive integer, and the representation levels are ±(½+l)·δ. To each of the representation levels a level number is assigned which is passed on to the multiplexer 16.

In the case reflection coefficients are used, these coefficients are non-uniformly quantized by the quantizer 14. The decision levels are given by $$D = \frac{1 - e^{\pm\left(\frac{1}{2}+l\right)\delta}}{1 + e^{\pm\left(\frac{1}{2}+l\right)\delta}} \tag{2}$$

and the representation levels are given by $$D = \frac{1 - e^{\pm l\delta}}{1 + e^{\pm l\delta}} \tag{3}$$

In this case also a level number is assigned to each of the representation levels, which level number is passed on to the multiplexer 16.

The excitation signal determination means 9 determine an excitation signal to be used with the synthesis filter 28 in the receiver. The excitation signal can be determined in many ways as is known to those skilled in the art. It is e.g. possible to filter the input signal by an analysis filter and to use a coded version of the residual signal at the output of the analysis filter as excitation signal as is prescribed in the GSM 06.10 recommendation. It is also possible to determine an optimal excitation signal out of a limited number of possible excitations by means of an analysis by synthesis method, as in done in transmission systems using the CELP (Code Excited Linear Prediction) coding technology.

The coded excitation signal is multiplexed with the level numbers of the prediction coefficients in the multiplexer 16. The output signal of the multiplexer 16 is transmitted to the receiver 6.

In the receiver 6 the demultiplexer 20 separates the coded excitation signal and the level numbers of the prediction coefficients. As explained above the prediction coefficients are updated only once per S excitation subframes. The interpolator 22 determines for each of the subframes for all prediction coefficients an interpolated level number I[k] according to:

$$I[k] = \frac{(S - s - 1)\cdot C_p[k] + (1 + s)\cdot C[k]}{S} \tag{4}$$

In (4), $C_p[k]$ represents the previous set of level numbers, and C[k] represents the updated set of level numbers. s is the number of the subframe involved. The prediction coefficient decoder 24 determines the decoded prediction coefficients $\tilde{r}[k]$. The decoded prediction coefficients are applied to the synthesis filter, which generates from the excitation signal generated by the excitation generator a synthetic replica of the input signal of the transmitter.

In the quantizer 14, the prediction coefficients r[k] are applied to a first input of a processor 32. A first output of the processor 32, carrying an output signal k, is connected to a memory unit 34. An output of the memory unit 34 carrying an output signals I and N is connected to a second input of the processor 32. A second output of the processor 32, carrying output signal I, is connected to an input of a memory unit 30. An output of the memory unit 30 is connected to a third input of the processor 32. The level numbers C[k] are available at a third output of the processor 32.

Figure 3:
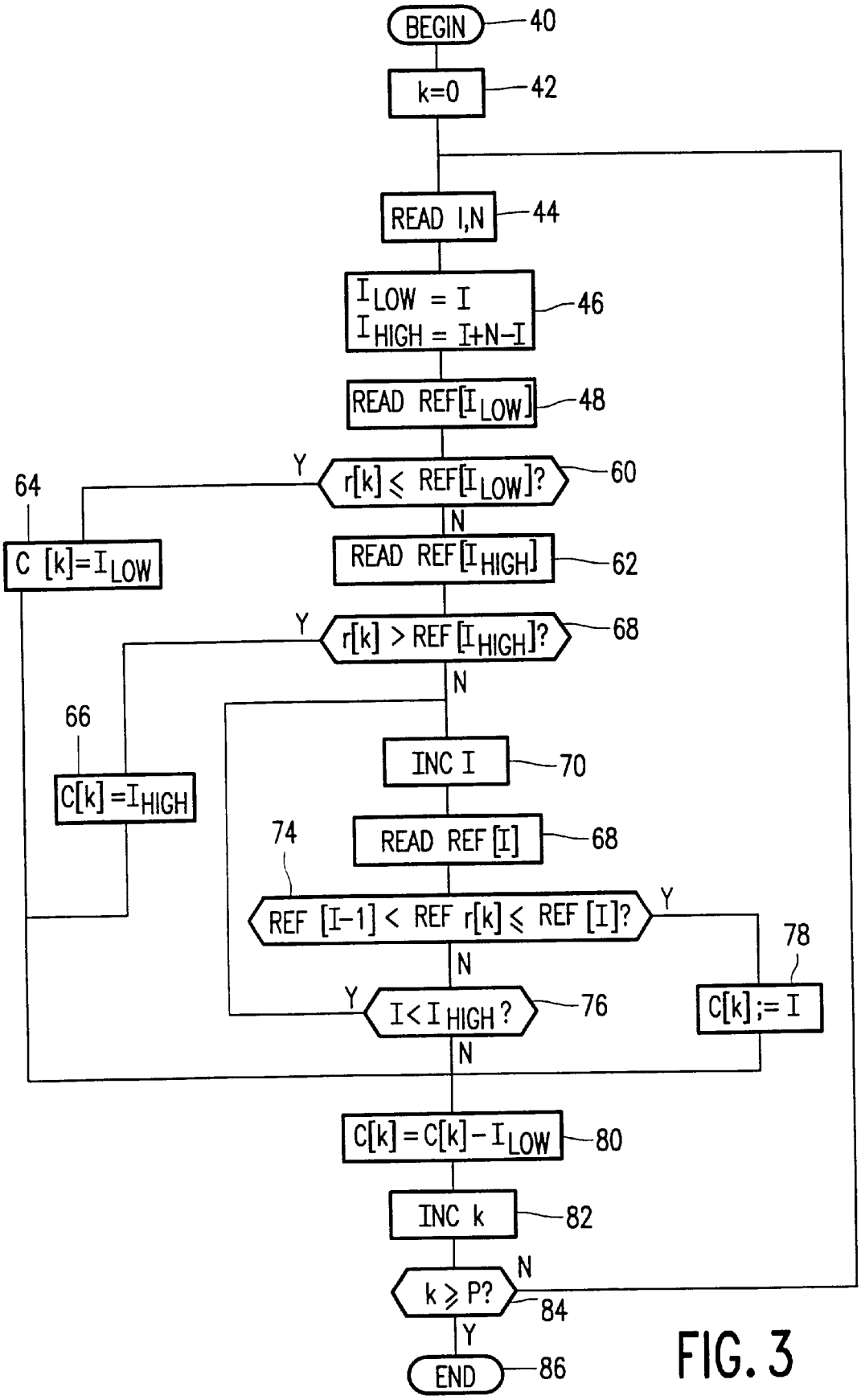
FIG. 3, a flow diagram for a program for the processor 32 in FIG. 2, performing the quantization according to the invention.

FIG. 3 shows a flowchart of a program for the processor 32 performing the quantization operation. In FIG. 3 the inscripts of the labelled blocks have the following meaning:

| No. | Inscript | Meaning |
|---|---|---|
| 40 | BEGIN | The program is started. |
| 42 | k = 0 | The variable k is set to 0 |
| 44 | READ I,N | The index I for the first reference value and the number of reference values to be used is read from the memory unit 34. |
| 46 | $I_{LOW} = I$<br>$I_{HIGH} = I + N - 1$ | The smallest index $I_{MIN}$ and the largest index $I_{MAX}$ are determined. |
| 48 | READ $REF[I_{LOW}]$ | The smallest reference value is read from the memory unit 30. |
| 60 | $r[k] \leqq REF[I_{LOW}]$? | r[k] is compared with the smallest reference value. |
| 62 | READ $REF[I_{HIGH}]$ | The largest reference value is read from the memory unit 30. |
| 64 | $C[k] = I_{LOW}$ | The value C[k] is made equal to $I_{LOW}$. |
| 66 | $C[k] = I_{HIGH}$ | The value C[k] is made equal to $I_{HIGH}$. |
| 68 | $r[k] > REF[I_{HIGH}]$? | r[k] is compared with the largest reference value. |
| 70 | INC I | The value of I is incremented. |
| 72 | READ REF[I] | The next reference value is read from the memory unit 30. |
| 74 | $REF[I - 1] < r[k] \leqq REF[I]$? | The value of r[k] is compared with two subsequent reference levels. |
| 76 | $I < I_{HIGH}$? | I is compared with the largest index $I_{HIGH}$. |
| 78 | C[k] = I | The value C[k] is made equal to I. |
| 80 | $C[k] = C[k] - I_{LOW}$ | C[k} is decrease with the $I_{LOW}$. |
| 82 | INC k | The value of k is incremented. |
| 84 | $k \geqq P$? | The value of k is compared with P. |
| 86 | END | The program is terminated. |

In instruction 40 of the flowgraph according to FIG. 3, the program is started and the relevant variables are initialized. In instruction 42 the value of k is set to 0 to indicate the prediction coefficient $\tilde{r}[0]$. In instruction 44 the index I of the first reference level stored in the memory means 30 and the number of reference levels involved with the quantization of r[k] are read from the memory means 34. The memory means 34 store the values of I and N as a function of k according to the Table 1 presented below.

TABLE 1

| k | I | N |
|---|---|---|
| 0 | 13 | 36 |
| 1 | 0 | 28 |
| 2 | 16 | 15 |
| 3 | 12 | 14 |
| 4 | 16 | 13 |
| 5 | 13 | 13 |
| 6 | 16 | 12 |
| 7 | 14 | 11 |
| 8 | 18 | 9 |
| 9 | 16 | 8 |
| 10 | 18 | 8 |
| 11 | 17 | 7 |
| 12 | 19 | 7 |
| 13 | 17 | 8 |
| 14 | 19 | 7 |
| 15 | 18 | 6 |
| 16 | 19 | 6 |
| 17 | 17 | 7 |
| 18 | 19 | 6 |
| 19 | 18 | 6 |

In this table 20 prediction coefficients are taken into account.

In instruction 46 the values of the minimum index and the maximum index to be used with the memory means 30 are calculated from N and I read from the memory means 34. In instruction 48 the reference value REF stored at index $I_{LOW}$ is read from the memory means 30. The reference values REF as a function of the index I are presented in Table 2 below.

TABLE 2

| I | REF |
|---|---|
| 0 | −0.9882 |
| 1 | −0.9848 |
| 2 | −0.9806 |
| 3 | −0.9751 |
| 4 | −0.9682 |
| 5 | −0.9593 |
| 6 | −0.9481 |
| 7 | −0.9338 |
| 8 | −0.9158 |
| 9 | −0.8932 |
| 10 | −0.8649 |
| 11 | −0.8298 |
| 12 | −0.7866 |
| 13 | −0.7341 |
| 14 | −0.6710 |
| 15 | −0.5964 |
| 16 | −0.5098 |
| 17 | −0.4116 |
| 18 | −0.3027 |
| 19 | −0.1853 |
| 20 | −0.0624 |
| 21 | 0.0624 |
| 22 | 0.1853 |
| 23 | 0.3027 |
| 24 | 0.4116 |
| 25 | 0.5098 |
| 26 | 0.5964 |
| 27 | 0.6710 |
| 28 | 0.7341 |
| 29 | 0.7866 |
| 30 | 0.8298 |
| 31 | 0.8649 |
| 32 | 0.8932 |
| 33 | 0.9158 |
| 34 | 0.9338 |
| 35 | 0.9481 |
| 36 | 0.9593 |
| 37 | 0.9682 |
| 38 | 0.9751 |
| 39 | 0.9806 |
| 40 | 0.9848 |
| 41 | 0.9882 |
| 42 | 0.9908 |
| 43 | 0.9928 |
| 44 | 0.9944 |
| 45 | 0.9956 |
| 46 | 0.9966 |
| 47 | 0.9973 |

The values in Table 2 are determined by calculating (2) for different values of 1, and with $\delta$=0.25.

In instruction 60 the value of r[k] is compared with the value $REF[I_{LOW}]$. If r[k] is smaller or equal to $REF[I_{LOW}]$ the level number C[k] is made equal to $I_{LOW}$ in instruction 64. Subsequently the program continues at instruction 80. If r[k] is larger than $REF[I_{LOW}]$, the value $REF[I_{HIGH}]$ is read in instruction 62 from the memory unit 30. In instruction 68 the value of r[k] is compared with $REF[I_{HIGH}]$. If the value of r[k] is larger than $REF[I_{HIGH}]$ the level number C[k] is made equal to $I_{HIGH}$ in instruction 66. Subsequently the program continues at instruction 80.

If the value of r[k] is smaller or equal than $REF[I_{HIGH}]$, the value of I is incremented in instruction 70. In instruction 72 the next reference value REF[I] is read from the memory means 32. In instruction 74 it is checked whether r[k] has a value between the previous and the current reference value. If this is the case, in instruction 78 the level number C[k] is made equal to I. Otherwise I is compared with $I_{HIGH}$. If I is smaller than $I_{HIGH}$, the program continues at instruction 70 with the next reference level. If I is larger or equal than $I_{HIGH}$, the program continues at instruction 80.

In instruction 80 the value of the level index C[k] is decreased with $I_{LOW}$. This is done to arrive at level numbers with values from 0 up to a maximum value.

In instruction 82 the value of k is incremented in order to deal with the quantization of the next prediction parameter. In instruction 84 k is compared with the prediction order P. If k is larger or equal than P the program continues at instruction 44 with the quantization of the next prediction parameter r[k]. Otherwise the program is terminated in instruction 86.

Figure 4:
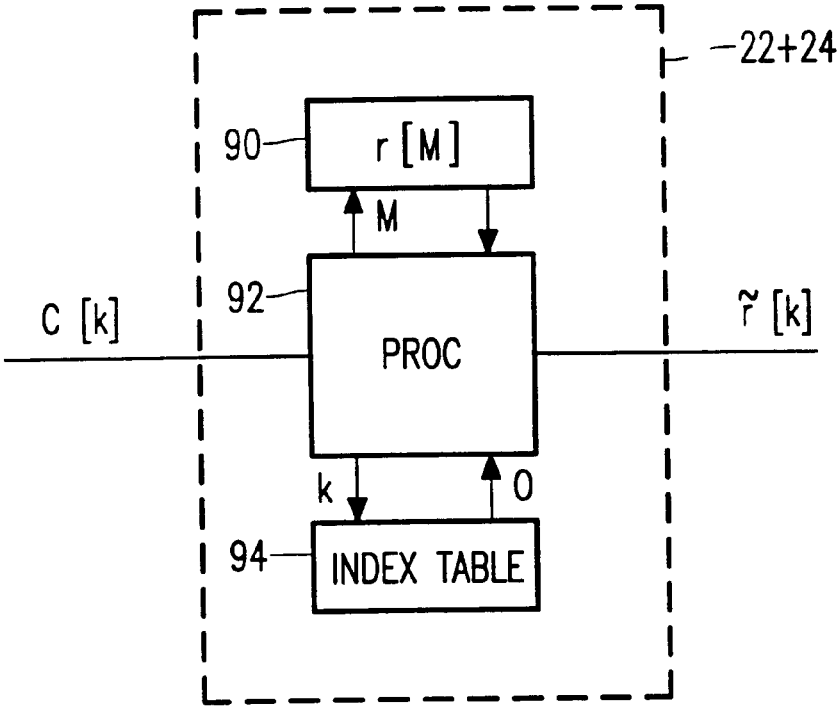
FIG. 4, an embodiment of the combination of the interpolator 22 and the decoding means 24 for use in the transmission system according to FIG. 1.

In the combination of the interpolator 22 and the prediction coefficient decoder 24 according to FIG. 4, the level numbers C[k] are applied to a first input of a processor 92. A first output of the processor 92, carrying an output signal k, is connected to a memory unit 94. An output of the memory unit 94, carrying an output signal O, is connected to a second input of the processor 92. A second output of the processor 92, carrying output signal M, is connected to an input of a memory unit 90. An output of the memory unit 90 is connected to a third input of the processor 32. The decoded prediction coefficients $\tilde{r}[k]$ are available at a third output of the processor 92.

Figure 5:
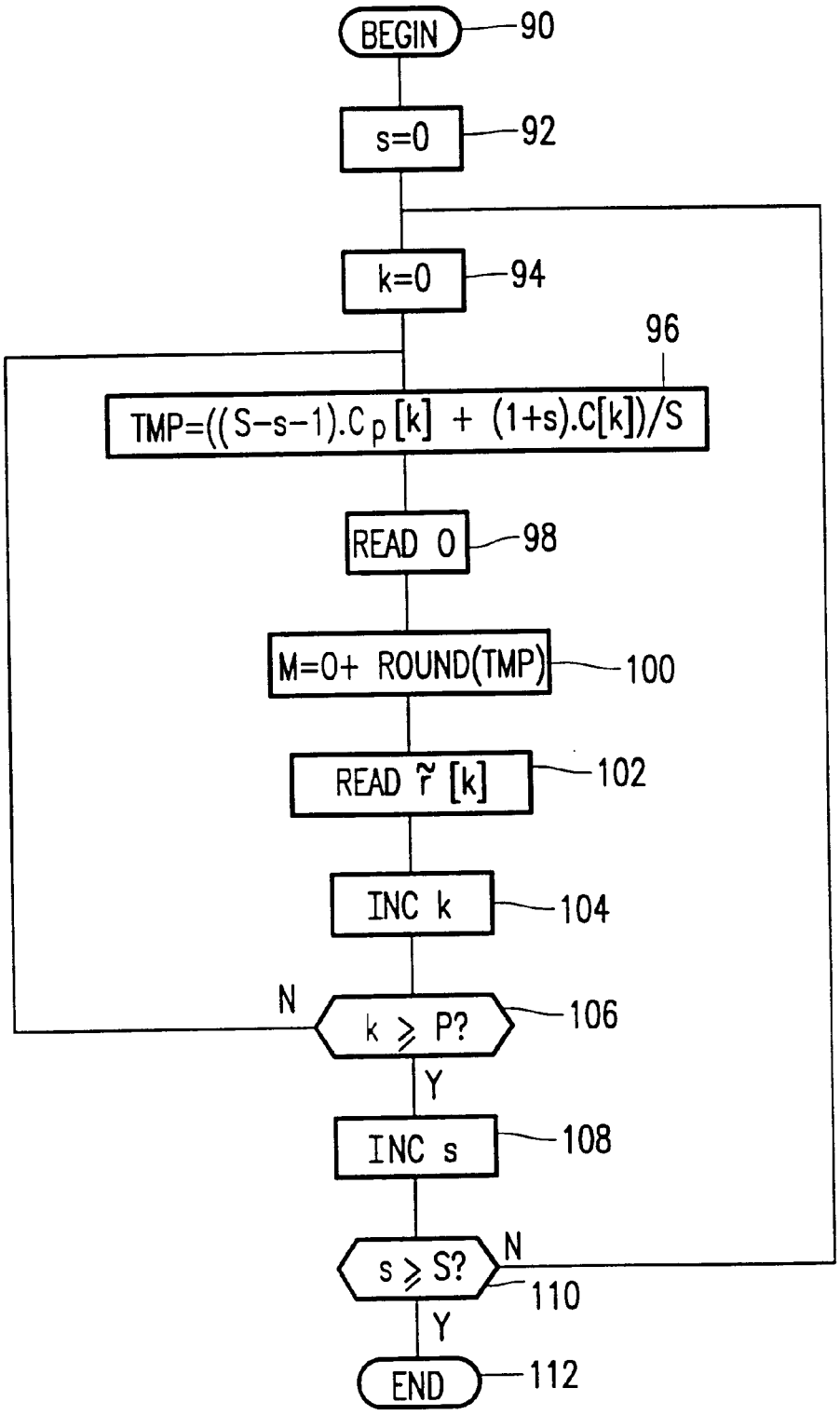
FIG. 5, a flow diagram for a program for the processor 92 in FIG. 4, performing the interpolation and decoding of the prediction coefficients according to the invention.

FIG. 5 shows a flowchart of a program for the processor 92 performing the function of the interpolator 22 and the prediction coefficient decoder 24. In FIG. 4 the inscripts of the labelled blocks have the following meaning:

| No. | Inscript | Meaning |
|---|---|---|
| 90 | BEGIN | The program is started. |
| 92 | s = 0 | The subframe index s is set to 0. |
| 94 | k = 0 | The variable k is set to 0 |
| 96 | TMP = ((S − s − 1) · $C_p$[k] + (1 + s) · C[k])/S | The interpolated level number is determined from the present and previous level number and the subframe index s. |
| 98 | READ O | The value of O(k) is read from the memory unit 94. |
| 100 | M = O + ROUND (TMP) | The index of the decoded prediction coefficient is calculated. |
| 102 | READ r[k] | The value of r[k] is read from the memory means 90. |
| 104 | INC k | The largest value k is incremented to deal with the next prediction parameter. |
| 106 | k ≧ P? | The value of k is compared with P. |
| 108 | INC s | Set s to a value indicating the next subframe. |
| 110 | s ≧ S? | s is compared with S. |
| 112 | END | The program is terminated. |

In instruction 90 the program according to the flowchart of FIG. 5 is started, In instruction 90 s is set to 0 indicating the first subframe. In instruction 96 an interpolated level number TMP is calculated from the previous set of level numbers $C_p$[k] the current set of level numbers C[k].

In instruction 98 the position O of the first value of $\tilde{r}[k]$ in the memory means 90 is read from the memory means 94. The memory means 94 hold a table similar as Table 1, but without the number of N because they are not needed for decoding.

In instruction 100 the position of the value of $\tilde{r}[k]$ corresponding to the level number ROUND(TMP) is calculated by adding the value O to the rounded value of TMP. In instruction 102, the value $\tilde{r}[k]$ is read from the memory unit 90. The values of $\tilde{r}$ as function of the index M are presented in Table 3 below.

TABLE 3

| M | $\tilde{r}$ |
|---|---|
| 0 | −0.9896 |
| 1 | −0.9866 |
| 2 | −0.9828 |
| 3 | −0.9780 |
| 4 | −0.9719 |
| 5 | −0.9640 |
| 6 | −0.9540 |
| 7 | −0.9414 |
| 8 | −0.9253 |
| 9 | −0.9051 |
| 10 | −0.8798 |
| 11 | −0.8483 |
| 12 | −0.8093 |
| 13 | −0.7616 |
| 14 | −0.7039 |
| 15 | −0.6351 |
| 16 | 0.5546 |
| 17 | −0.4621 |
| 18 | 0.3584 |
| 19 | −0.2449 |
| 20 | −0.1244 |
| 21 | 0 |
| 22 | 0.1244 |
| 23 | 0.2449 |
| 24 | 0.3584 |
| 25 | 0.4621 |
| 26 | 0.5546 |
| 27 | 0.6351 |
| 28 | 0.7039 |
| 29 | 0.7616 |
| 30 | 0.8093 |
| 31 | 0.8483 |
| 32 | 0.8798 |
| 33 | 0.9051 |
| 34 | 0.9253 |
| 35 | 0.9414 |
| 36 | 0.9540 |
| 37 | 0.9640 |
| 38 | 0.9719 |
| 39 | 0.9780 |
| 40 | 0.9828 |
| 41 | 0.9866 |
| 42 | 0.9896 |
| 43 | 0.9919 |
| 44 | 0.9937 |
| 45 | 0.9951 |
| 46 | 0.9961 |
| 47 | 0.9970 |
| 48 | 0.9977 |

The entries of Table 3 have been determined by calculating (3) using δ−0.25. In instruction 104, the value of k is incremented as preparation for the determination of the next value of $\tilde{r}[k]$. In instruction 106 k is compared with P. If k is smaller than P, the program is continued at instruction 96 for determining the next value of $\tilde{r}[k]$. Otherwise the value of s is incremented in instruction 108. In instruction 110, the value of s is compared with S. If s is smaller than S, the program is continued at instruction 94 for determining the values of $\tilde{r}[k]$ for the next subframe. Otherwise the program is terminated in instruction 112.

It is possible to merge the Tables 2 and 3 into one single table with an increased number of entries. The single table is given below as Table 4. The even entries of table 4 hold the values $\tilde{r}[k]$, and the odd entries hold the reference values REF.

TABLE 4

| I | VALUE |
|---|---|
| 0 | −0.9896 |
| 1 | −0.9882 |
| 2 | −0.9866 |
| 3 | −0.9848 |
| 4 | −0.9828 |
| 5 | −0.9806 |
| 6 | −0.9780 |
| 7 | −0.9751 |
| 8 | −0.9719 |
| 9 | −0.9682 |
| 10 | −0.9640 |
| 11 | −0.9593 |
| 12 | −0.9540 |
| 13 | −0.9481 |
| 14 | −0.9414 |
| 15 | −0.9338 |
| 16 | −0.9253 |
| 17 | −0.9158 |
| 18 | −0.9051 |
| 19 | −0.8932 |
| 20 | −0.8798 |
| 21 | −0.8649 |
| 22 | −0.8483 |
| 23 | −0.8298 |
| 24 | −0.8093 |
| 25 | −0.7866 |
| 26 | −0.7616 |
| 27 | −0.7341 |
| 28 | −0.7039 |
| 29 | −0.6710 |
| 30 | −0.6351 |
| 31 | −0.5964 |
| 32 | −0.5546 |
| 33 | −0.5098 |
| 34 | −0.4621 |
| 35 | −0.4116 |
| 36 | −0.3584 |
| 37 | −0.3027 |
| 38 | −0.2449 |
| 39 | −0.1853 |
| 40 | −0.1244 |
| 41 | −0.0624 |
| 42 | 0 |
| 43 | 0.0624 |
| 44 | 0.1244 |
| 45 | 0.1853 |
| 46 | 0.2449 |
| 47 | 0.3027 |
| 48 | 0.3584 |
| 49 | 0.4116 |
| 50 | 0.4621 |
| 51 | 0.5098 |
| 52 | 0.5546 |
| 53 | 0.5964 |
| 54 | 0.6351 |
| 55 | 0.6710 |
| 56 | 0.7039 |
| 57 | 0.7341 |
| 58 | 0.7616 |
| 59 | 0.7866 |
| 60 | 0.8093 |
| 61 | 0.8298 |
| 62 | 0.8483 |
| 63 | 0.8649 |
| 64 | 0.8798 |
| 65 | 0.8932 |
| 66 | 0.9051 |
| 67 | 0.9158 |
| 68 | 0.9253 |
| 69 | 0.9338 |
| 70 | 0.9414 |
| 71 | 0.9481 |
| 72 | 0.9540 |
| 73 | 0.9593 |
| 74 | 0.9640 |
| 75 | 0.9682 |
| 76 | 0.9719 |

TABLE 4-continued

| I | VALUE |
|---|---|
| 77 | 0.9751 |
| 78 | 0.9780 |
| 79 | 0.9806 |
| 80 | 0.9828 |
| 81 | 0.9848 |
| 82 | 0.9866 |
| 83 | 0.9882 |
| 84 | 0.9896 |
| 85 | 0.9908 |
| 86 | 0.9919 |
| 87 | 0.9928 |
| 88 | 0.9937 |
| 89 | 0.9944 |
| 90 | 0.9951 |
| 91 | 0.9956 |
| 92 | 0.9961 |
| 93 | 0.9966 |
| 94 | 0.9970 |
| 95 | 0.9973 |
| 96 | 0.9977 |
| 97 | 0.9999 |
| 98 | |
| 99 | |

In order to be able to address Table 4, the programs according to FIG. 3 and FIG. 5 have to be slightly modified. In the program according to FIG. 3, in the instructions 48, 62, 68, 72 and 74 the index x used to address REF[x] has to be replaced by 2x+1. Instruction 48 e.g. has to be modified into READ REF[$2 \cdot I_{LOW2}+1$].

The merged table allows a finer interpolation of $\tilde{r}[k]$ by using the reference levels stored in Table also as values of $\tilde{r}[k]$. In order to obtain this, instruction 100 in FIG. 5 has to be changed into M=2·O+ROUND(2·TMP).

We claim:

1. A transmission system comprising a transmitter having an encoder for coding an input signal of the transmitter, said encoder comprising analysis means for deriving at least one analysis coefficient from the input signal, and quantization means for deriving a level number representing and requiring less numerical precision than a quantization level of said analysis coefficient, the transmitter being arranged for transmitting an encoded signal comprising the level number to a receiver, the receiver comprising a decoder for deriving a decoded signal from the encoded signal, wherein the decoder comprises interpolation means for deriving from at least two subsequently received level numbers corresponding to said analysis coefficient an interpolated level number, and analysis coefficient decoding means for deriving a value for a decoded analysis coefficient corresponding to said interpolated level number.

2. The transmission system according to claim 1, wherein the level numbers correspond to levels of a first type of analysis coefficient, and the decoded analysis coefficient is of a second type of analysis coefficient.

3. The transmission system according to claim 2, wherein the first type of analysis coefficient comprise log area ratios, and the second type of analysis coefficient comprise reflection coefficients.

4. The transmission system according to claim 1, wherein the analysis means are arranged for deriving a plurality of analysis coefficients from the input signal, the decoder comprises means for deriving from the received level numbers for the analysis coefficients involved, analysis coefficient indices, and the analysis coefficient decoding means comprises common decoding table means for deriving decoded analysis coefficients corresponding to said analysis coefficient indices.

5. The transmission system according to claim 1, wherein the analysis means are arranged for determining a plurality of analysis coefficients, the quantization means comprises comparing means for comparing at least one of the analysis coefficients with at least one of a plurality of reference levels stored in encoding table means as function of an index in order to determine the level number of said analysis coefficient, and the quantization means comprises level determining means for determining for at least one of the plurality of analysis coefficients the indices of the encoding table means involved in the quantization of the analysis coefficient.

6. A receiver for receiving an encoded signal comprising a quantization level number representing and requiring less numerical precision than at least one analysis coefficient, said receiver comprising a decoder for deriving a decoded signal from the encoded signal, wherein the decoder comprises interpolation means for deriving from at least two subsequently received level numbers corresponding to said analysis coefficient an interpolated level number, and decoding table means for deriving a value for a decoded analysis coefficient corresponding to said interpolated level number.

7. The receiver according to claim 6, wherein the decoder comprises means for deriving from the received level numbers for at least one analysis coefficient an index for the decoding table means, and the decoding table means comprise common table means for the analysis coefficients involved.

8. A decoder for deriving a decoded signal from an encoded signal comprising a quantization level number of at least one analysis coefficient, wherein the decoder comprises interpolation means for deriving from at least two subsequently received level numbers corresponding to said analysis coefficient an interpolated level number, and the decoder comprises analysis coefficient decoding means for deriving a value for a decoded analysis coefficient corresponding to said interpolated level number.

9. A decoder for deriving a decoded signal from an encoded signal comprising a quantization level number of at least one analysis coefficient, wherein the decoder comprises interpolation means for deriving from at least two subsequently received level numbers corresponding to said analysis coefficient an interpolated level number, and the decoder comprises analysis coefficient decoding means for deriving a value for a decoded analysis coefficient corresponding to said interpolated level number.

* * * * *